US005423544A

United States Patent [19]

Ichikawa

[11] Patent Number: 5,423,544

[45] Date of Patent: Jun. 13, 1995

[54] PUTTER HEAD

[75] Inventor: Toshio Ichikawa, Tokorozawa, Japan

[73] Assignee: Satoshi Ichikawa, Tokyo, Japan

[21] Appl. No.: 217,107

[22] Filed: Mar. 24, 1994

[30] Foreign Application Priority Data

Apr. 30, 1993 [JP] Japan ..... 5-023007 U

[51] Int. Cl.[6] ..... A63B 53/04

[52] U.S. Cl. ..... 273/164.1; 273/167 F; 273/169

[58] Field of Search ..... 273/191 R, 192, 193 R, 273/194 R, 194 A, 194 B, 167 R, 167 F, 169, 170, 171, 164.1

[56] References Cited

U.S. PATENT DOCUMENTS 4,322,083 3/1982 Imai ..... 273/167 F
5,167,414 12/1992 Montgomery III ..... 273/169
5,211,401 5/1993 Hainey ..... 273/167 F
5,308,069 5/1994 Paquette ..... 273/164.1
5,333,870 8/1994 Stevenson, Jr. ..... 273/164.1

OTHER PUBLICATIONS

Section 1, "Sweet Spot" In Chapter 7 Patter Of Textbook for Patting (Ed. By Junji Shibakusa), Dec. 6, 1988, pp. 199–204. Translation of the Related pp. 202–203 is Attached.

*Primary Examiner*—William H. Grieb
*Attorney, Agent, or Firm*—Oblon, Spivak, McClelland, Maier & Neustadt

[57] ABSTRACT

A flange member is joined to a rear surface of a face member, which defines a sole, and extends backward. A sole member depends from the flange member and defines a further sole.

4 Claims, 17 Drawing Sheets

PUTTER HEAD

BACKGROUND OF THE INVENTION

The present invention relates to a golf club putter head of a putter.

Terms and names with respect to golf club and golf play in this specification are those which are defined in official golf rules and those which are commonly accepted among golfers, and are used in the specification according to the spirit of official golf rules.

While golf clubs except putters are designed to drive and fly a golf ball for a desired distance, putters are designed to roll the ball (about 42.6 mm in outer diameter) on a putting green (where grass is cropped short for easier rolling of the ball) into or nearer a cup (about 108 mm in inner diameter) located in the green.

A putter shot, which is final in each hole (generally, a golf course has 18 holes), is said to be most mentally affected and requires very delicate controls of feeling and of force to be imparted to the ball. The slightest failure in address (posture for setting golf club beside and without contacting golf ball preparatory to hitting the same) as well as in swinging the club may greatly affect rolling of the ball hit.

FIGS. 1 to 3 are a schematic perspective view, a top view and a front view of a traditional putter with the simplest design, respectively.

The putter with the simplest design comprises a face member F, a neck N, a shaft S and a grip GR (omitted in FIGS. 1 to 3; see FIG. 17) continuous with a top of the shaft S. A part including the face member F and the neck N is called a putter head.

According to official golf rules, the neck N is not indispensable for the putter head. The putter head may comprise only the face member F.

The face member F, which has a substantially flat face 1 (requirement according to official golf rules), is joined to no members at all at its back surface 3 oppositely of the face 1 and therefore is very simple in structure. A lowermost portion of the face member F defines a sole 2 which contacts or is closest to a turf surface TF.

According to official golf rules, the face member F may have any thickness providing that its strength is within a range where no adverse effects such as a spring effect are produced upon impact (instant of the face 1 striking the ball B).

There is a sweet spot SS on the face 1 which is a vital spot in that the striking energy of the putter is most effectively transmitted to the ball B when the ball B is putted by the putter at its sweet spot SS.

Position of the sweet spot SS will be substantially dependent upon vertical and longitudinal sizes and mass distribution of the face member F.

When the ball B is putted by the putter at its point away from the sweet spot SS by a distance d, a force b is produced by the ball B to urge the face 1 to rotate about a vertical axis C which crosses the sweet spot SS. The longer the distance d of the actual putting or impact point from the sweet spot SS, the stronger the force b is which urges the face 1 to rotate. Due to energy wasted for the force b, the rolled distance of the ball B becomes shorter. However, it is extremely difficult even for a professional golfer to accurately strike the ball B by the sweet spot SS of the face 1.

FIGS. 4 to 6 are a schematic perspective view, a top view and a front view of a putter head which is prevailing, respectively.

The prevailing putter head has a flange member FL attached to a back surface 3 of a thin face member F to extend along directions of toe T and heel H of the member F. This increases the size of the sole 2 in the swinging direction and the depth of the center of gravity G in the putter head (distance of the center of gravity G from the face 1) as well as moment of inertia of the putter head, so that the sweet spot SS on the face 1 is widened into a sweet spot area SSA in the directions of toe T and heel H to increase a region of sweet spot effect.

In utilization of such sweet spot area SSA, most of the prevailing putters are such that more or less deviation of the impact point from the sweet spot SS toward toe T or heel H makes less adverse effect on the rolling distance of the ball B.

Such putter head has the flange member FL and sole 2 increased in size in the direction of swinging the putter head so that the mass is concentrated to the very portion increased in size and the center of gravity G is deeper and lower (See FIG. 6). As a result, a swinging motion is readily well-balanced and backswing and downswing become smoother. Since the center of gravity G is low, a golfer can readily drive the ball B in an upper blow direction to impart top spin to the ball B, making the ball rotate smoother.

On the other hand, the position of the sweet spot SS or sweet spot area SSA on the face 1 disadvantageously becomes too low since the flange member FL is joined to the lower portion of the face 1. That is, there arises a problem that the sweet spot or sweet spot area position becomes too low in the vertical direction while the region of sweet spot effect may be widened in the directions of toe T and heel H.

FIG. 7 is a vertical sectional view of a putter head at its sweet spot SS and illustrates the position relationship between the ball B and the sweet spot SS of the face 1 upon address.

According to official golf rules, the outer diameter D of the ball B is about 42.6 mm or more and the height h-e of the horizontal equator E of the ball B above the turf surface TF is, therefore, 42.6 mm$\times\frac{1}{2}$=21.3 mm when the ball B remains standing still on the flat turf surface TF.

In practice, however, the ball B point-contacts the turf surface TF at BL and the whole weight of the ball B (about 46 g) is supported at the point of contact BL so that the ball B should be considered to sink below the turf surface TF. Height h-t of the turf, which varies depending upon conditions of the putting green, is generally within a range of 3 to 5 mm.

Therefore, assuming that the sunk depth of the ball B in the green is 3.5 mm on an average, the height h-e in the actual putter shot on the green is estimated to be about 18 mm (42.6 mm$\times\frac{1}{2}$-3.5 mm). When the face 1 is held vertical to the turf surface TF and the impact is made with the sole 2 being moved in close contact with the turf surface TF, the face 1 strikes the horizontal equator E of the ball B at the height h-e or intersection of the face 1 with the horizontal plane at the height of 18 mm measured vertically from the lowermost end of the sole 2 (or ordinarily the lowermost end of the putter head).

The height h-s of the sweet spot SS of the sweet spot area type putters which are now prevailing is 10 mm or so measured from the lowermost end of the putter head so that its difference from the height h-e is 8 mm or so. In other words, in most of the conventional putters, when the ball B is putted by the putter such that the sole 2 is slided on the turf surface TF with the face 1 being perpendicular to the ball B upon impact, the face 1 contacts the ball B not at the sweet spot SS but at a point above the sweet spot SS.

FIGS. 9, 10 and 11 are front views of the putter heads and the balls to show variations in putter shot upon impact with the sweet spot SS being varied in height by vertically changing the attaching position of the flange member FL to the face member F.

In order to strike the ball B by the sweet spot SS of the face 1 of a prevailing putter head as shown in FIG. 10 in which the flange member FL is attached to a lower portion of the face member F to widen the sweet spot SS into the sweet spot area SSA in the directions of toe and heel, the impact must be made with the sole 2 being above the turf surface TF by about 8 mm or so; or a lower surface below the horizontal equator E of the ball B must be struck in an upper blow direction 10 as shown by an arrow in FIG. 10. In the latter case, the face 1 contacts the surface below the equator E of the ball B in the upward direction already upon impact so that the putter head may strike the ball B by its sweet spot SS even though the sweet spot SS is low in position.

Under such circumstances, it is not too much to say that "most of the prevailing putters are designed to strike a ball in an upper blow direction".

When the ball B is struck in the upper blow direction upon impact as shown in FIG. 10, top spin 11 is imparted to the ball B to rotate the ball B in the forward direction immediately after the impact so that advantageously the ball B rolling forward receives less resistance from the turf.

However, upon impact, if the face 1 contacts the ball B at a point too low below the horizontal equator E and/or the force imparted to the ball B is too strong, the ball B is forced to fly into the air immediately after the impact and then drops on the turf surface to receive resistance from the turf with top spin 11 being imparted to the ball B. Therefore, skills in adjusting not only a degree of upper blow but also power imparted to the ball B are so difficult to acquire that even professional golfers take a relatively long time before they successively acquire such skills.

It has been said that the most positive way or principle of imparting top spin to the ball immediately after impact is such that, as shown in FIG. 9, the face 1 of the putter is made vertical upon address, strikes the horizontal equator E of the ball B with the face 1 being maintained vertical upon impact and is swung in the upper blow direction after impact.

This putting way or principle is clear and simple with respect to required conditions of the face 1 upon address and upon impact and is less dependent upon a golfer's feeling in putt shot practices. However, most of the prevailing putters cannot strike a ball by their sweet spot SS when such putting way or principle is applied or employed.

Position of a sweet spot SS on a face of a putter head is an important factor in designing a putter so as to ensure that the putter head strikes a ball by its sweet spot using the above-mentioned putting way or principle.

As described hereinbefore with reference to FIG. 7, it is understood that the position of contact of the face 1 with the ball B is not excess of 18 mm vertically measured from the lowermost end of the sole 2 when the ball B is putted at its horizontal equator E by the face 1 with the face 1 being perpendicular to the turf surface TF and the sole 2 being closest to the turf surface TF upon impact.

To intentionally make the sole 2 closest to the turf surface TF during downswing in the putter shot which shot demands for mental and delicate adjustment of power to be imparted to the ball B is accompanied with a risk of "duff" (misplay to strike the ground or the turf before striking the ball) and therefore requires extreme putting skills.

As shown in FIG. 8, in general there will be a distance h-2 between the sole 2 and the turf surface TF (or height of the sole 2 from the turf surface TF) on the order of 3 mm on average, though this varies from one golfer to another. Therefore, when the putter strikes the ball B upon impact with its face 1 being perpendicular to the turf surface TF, the face 1 is estimated to contact the ball B at the sweet spot area SSA at a height which is within 3 mm above or below the line of intersection of the face 1 with a horizontal plane SF (to be referred to as sweet spot reference plane SF hereinafter) whose height is 15 mm measured vertically from the lowermost end of the putter head.

Such estimated position of the sweet spot area SSA (or 15 mm±3 mm from the lowermost end of the putter head) is substantially consistent with results of shot tests conducted by pasting a mark sheet over the face of the putter head.

It follows therefore that when impact is made with the face 1 of the putter being perpendicular to the turf surface TF, the height of the sweet spot SS on the face 1 are to be substantially equal to the height of the intersection of the sweet spot reference plane SF with the face 1. It is therefore understood that in prevailing putters having sweet spot area SS widened in the directions of toe and heel, the position of the sweet spot SS is too low to perform the putting in the way described above.

In order to raise the position of the sweet spot SS higher than that of the sweet spot SS widened in the directions of toe and heel as in the prevailing putters, the putter head must be enlarged to increase the height of the face member; or a flange member must be joined to the back surface of the face member such that the mass distribution of the face member is concentrated to a higher position.

A putter with such an enlarged putter head once prevailed but is rarely used now since the weight of the putter head was increased accordingly to cause problems of materials to be used and of feeling.

Joining a flange member to a back surface of a face member at a higher position can raise the sweet spot SS on the face at least adjacent to a position adjacent to the joint of the flange member to the face member. Such idea of adjusting in height the position of the sweet spot SS of the putter head by selecting the joining position of the flange member to the face member is efficient in designing a putter head. However, when the position of the sweet spot SS on the face 1 is too high, the face 1 tends to be swung in a down blow direction as shown in FIG. 11 so that back spin 12 is imparted to the ball B, resulting in difficulty of controlling the distance over which the ball rolls.

As described above, in the prevailing putter heads, the effective region of the sweet spot SS on the face is widened in the directions of toe and heel for compensation of more or less deviation of the contact of the face with the ball from the sweet spot SS in the directions of toe and heel.

Since great importance in design is attached to such compensation of deviation in the directions of toe and heel, the effective region of the sweet spot SS in the vertical direction tends to be low. As described above, it is said that the putters now prevailing are designed for putting in an upper blow direction; a golfer must intentionally control the face of the putter in the upper blow direction just before the impact so as to attain contact of the face of the putter head with the ball B at its effective region of the sweet spot SS. Accuracy of the putting is greatly dependent upon feeling and skill of a golfer. It is said that in order to acquire know-how of putter techniques, professional golfers use a substantial part of practice time on the green.

As described above, with the conventional putters, even professional golfers take a considerably long time before they can acquire the skill of putting so as to make the face of the putter accurately contact at its effective region of sweet spot SS with the ball and to impart a degree of top spin depending upon a distance over which the ball is to roll, thereby controlling the rotation of the ball. In the case of a mature golfers with poor stroke skill who can afford only a short time for practice compared with professional golfers, it is next to impossible to acquire the above-described skill or technique. Every golfer realizes that when he or she fails to contact the effective region of the sweet spot SS of the face with the ball, response is not satisfactory and the ball tends to stop rolling short of the cup.

Effective in view of the above is a proposal for joining the flange member to the back surface of the face member such that the distribution of is concentrated to the joint surface of the face member with the flange member and the sweet spot area SSA is defined on the face opposite to the joint surface of the face member with the flange member.

FIG. 12 is a schematic perspective view of a putter head devised for alignment between the center of the sweet spot area SSA and the line of intersection SX of the reference plane SF with the face 1.

When the vertical center of the joint surface of the flange member FL is aligned with the sweet spot reference plane SF at the back surface 3 of the face member F, the more the flange member FL extends, the greater the difference in mass between the face and flange members F and FL becomes so that the center of the sweet spot area SSA is located closer to or is substantially aligned with the line SX of intersection between the reference plane SF and the face 1. It follows therefore that even though there may be some differences depending upon shape and mass distribution of the face member F, at least part of joint of the flange member FL must be within the range of the sweet spot reference plane SF±3 mm in which the face contacts the ball B upon impact.

When the flange member FL joined to the back surface 3 of the face member F further extends as shown at FL-L in FIG. 12, the center of gravity of the putter head is caused to be located backwardly. As a result, a golfer feels to putt the ball B by the leading end of the flange member FL rather than by the face 1. In other words, the golfer feels as if he or she struck the ball by a nail-striking face of a hammer.

The above-described hammer type putter is said to be an ideal putter owing to its high probability of cup-in. However, the length of the flange member FL is limited since the official golf rules stipulate that "distance from heel to toe of a club head must be longer than distance from the face to the rear surface thereof (W>L) and each club must have a shape or structure which is not essentially different from that in accordance with the tradition and customs."

Even when the length of the flange member FL of the putter of the type shown in FIG. 12 is selected within the range of W>L, there may be a possibility that a golfer has a feeling of physical disorder as compared when the conventional putter is used. The feeling of physical disorder presents a serious problem since mental control of the body greatly affects the putting.

Moreover, thinness or narrowness of the sole F-2 defined at the lowermost end of the thin face member F may cause a golfer to have a feeling of instability upon address and fear of "duff" during putting.

BRIEF SUMMARY OF THE INVENTION

In view of the above, the present invention has for its object to provide a putter head which can minimize mental factor in putting shot which in turn conventionally demands skills readily affected by mental conditions of a golfer; when a golfer practices according to a predetermined lesson, using a putter head according to the present invention, he or she can easily strike a golf ball by the effective area of the sweet spot SS on the face to impart top spin to the ball so that the ball may start rolling forward immediately after impact.

The present invention will become more apparent from the following description of preferred embodiments thereof taken in conjunction with the accompanying drawings.

DETAILED DESCRIPTION OF THE PREFERRED EMBODIMENTS

Figure 1:
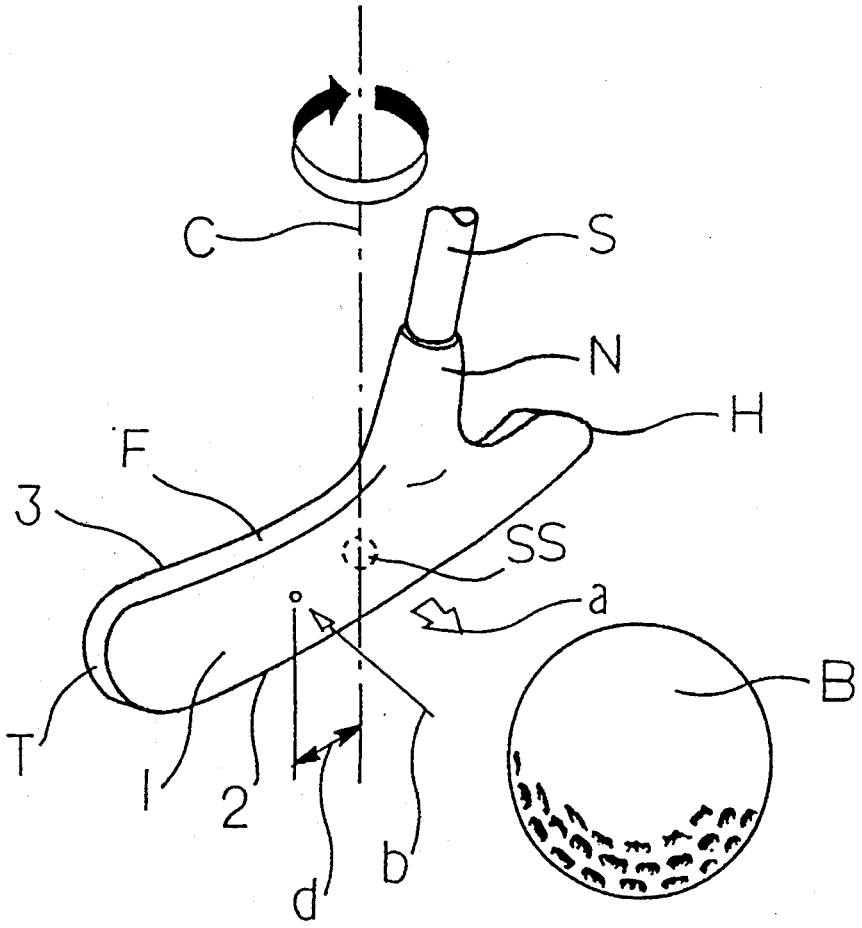
FIG. 1 PRIOR ART
FIG. 1 is a schematic perspective view of a conventional putter head.
Figure 2:
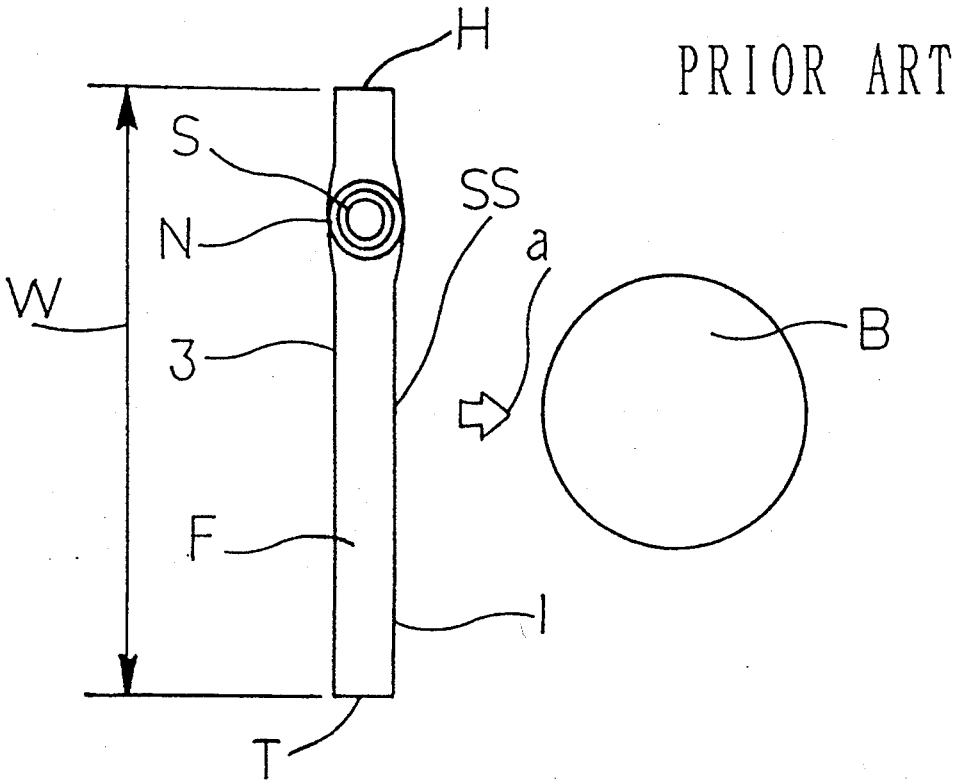
FIG. 2 is a top view thereof.
Figure 3:
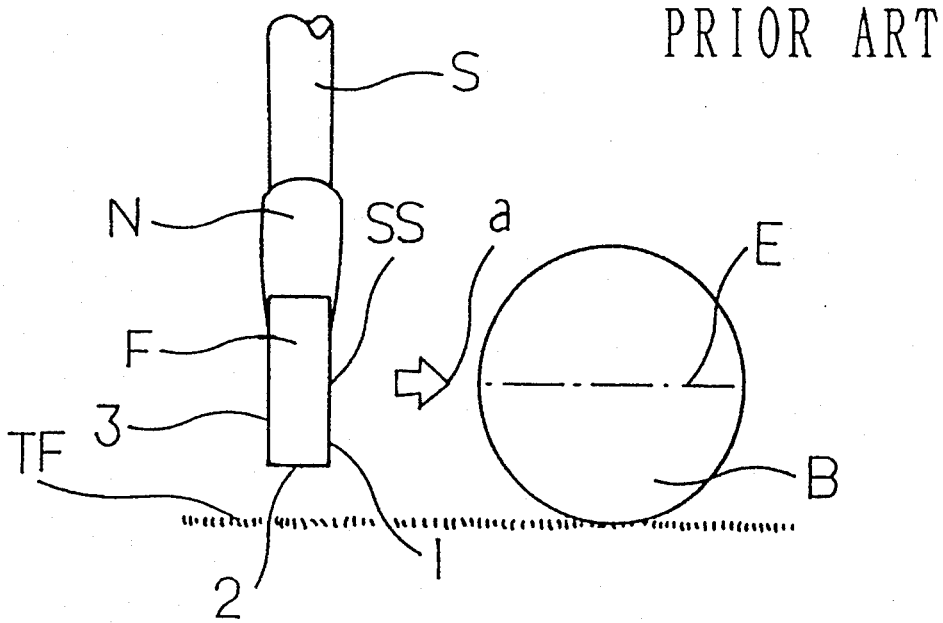
FIG. 3 is a front view thereof.
Figure 4:
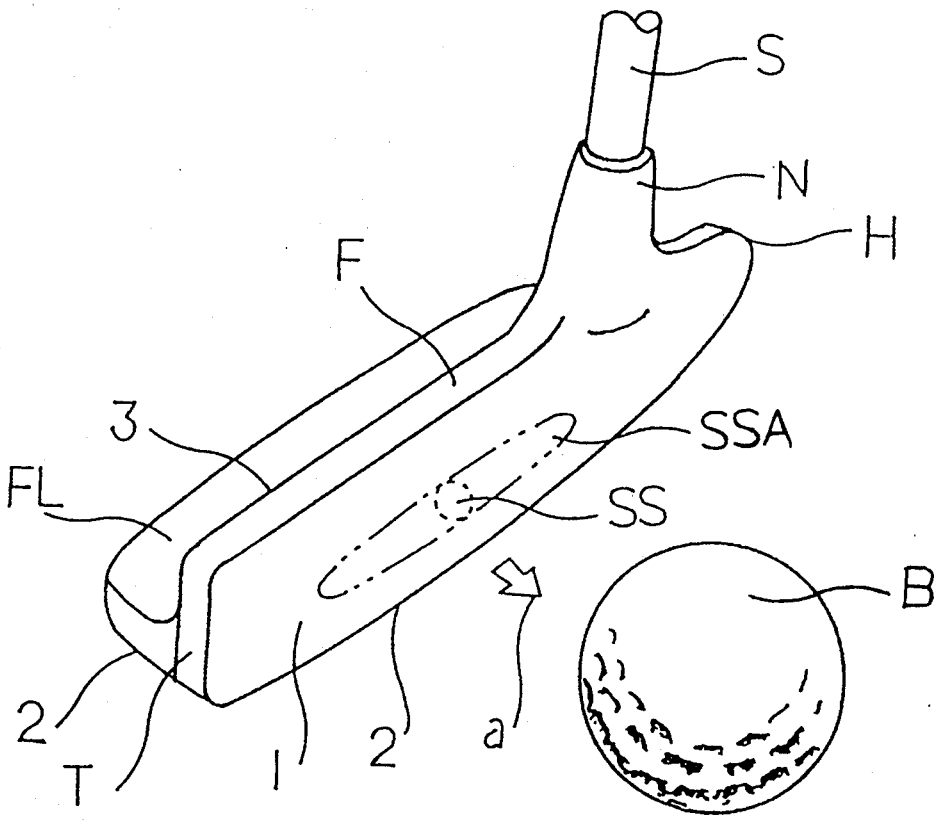
FIG. 4 PRIOR ART
FIG. 4 is schematic perspective view of a prevailing putter head.
Figure 5:
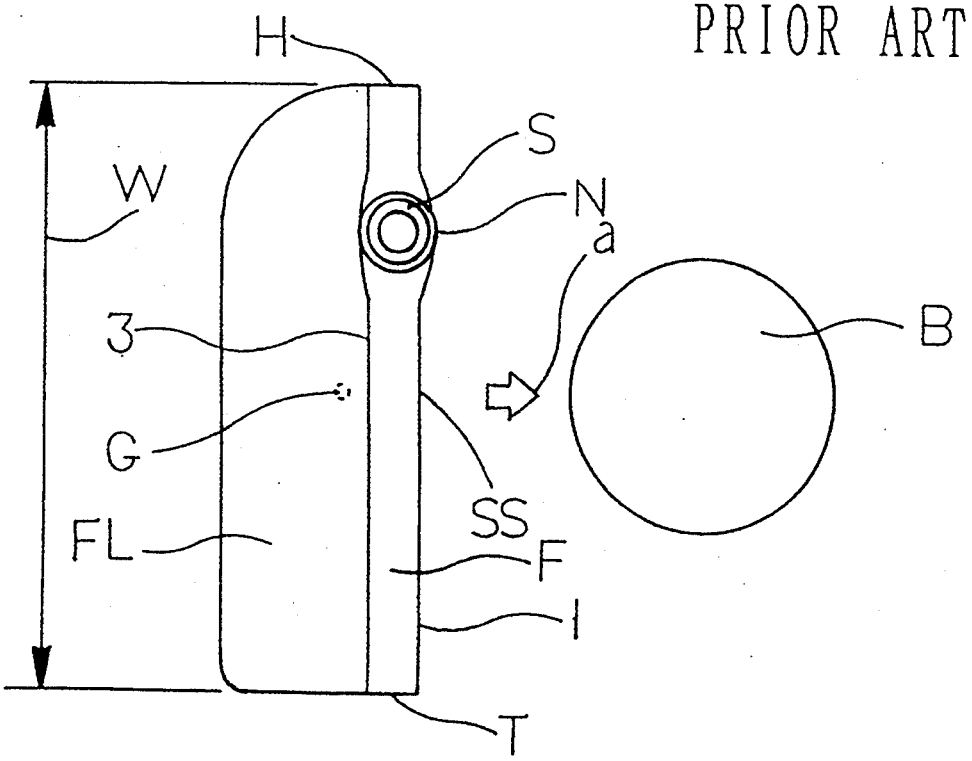
FIG. 5 PRIOR ART
FIG. 5 is a top view thereof.
Figure 6:
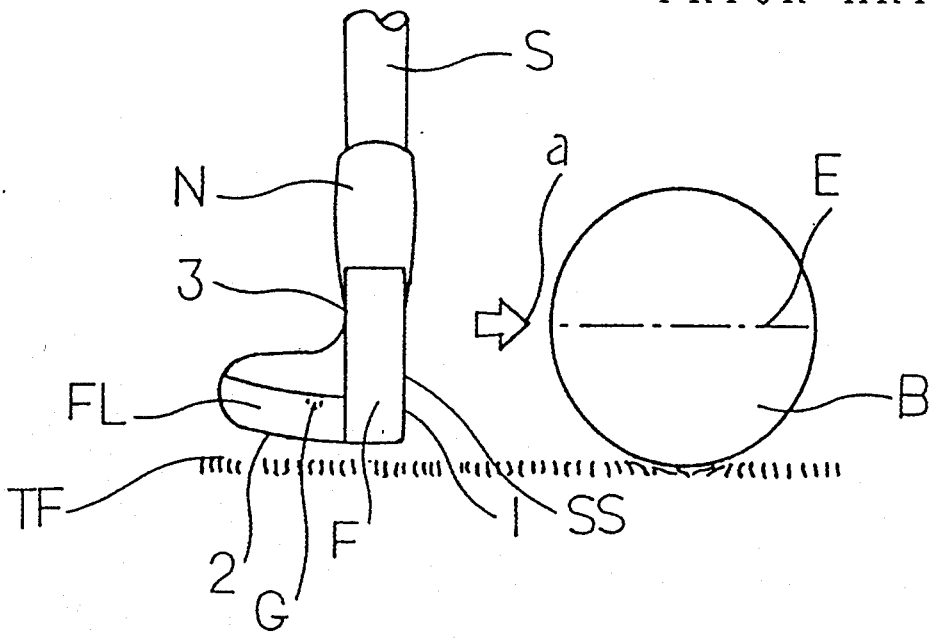
FIG. 6 PRIOR ART
FIG. 6 is a front view thereof.
Figure 7:
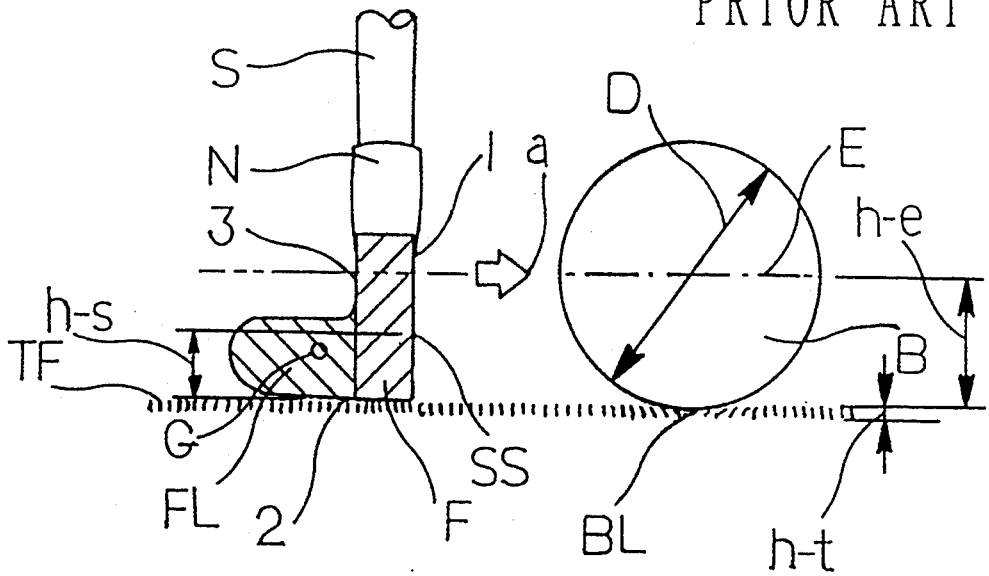
FIG. 7 PRIOR ART
FIG. 7 is a view illustrating the relationship between a golf ball placed on turf surface and the putter head of FIG. 6 shown in cross section.
Figure 8:
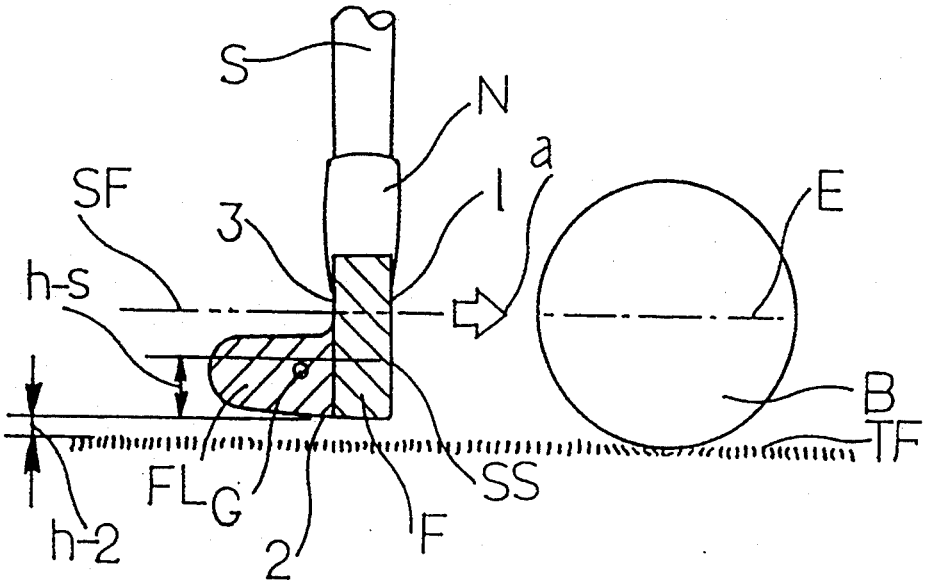
FIG. 8 PRIOR ART
FIG. 8 is a view illustrating the relationship between a golf ball on the turf surface and the sweet spot reference plane SF.
Figure 9:
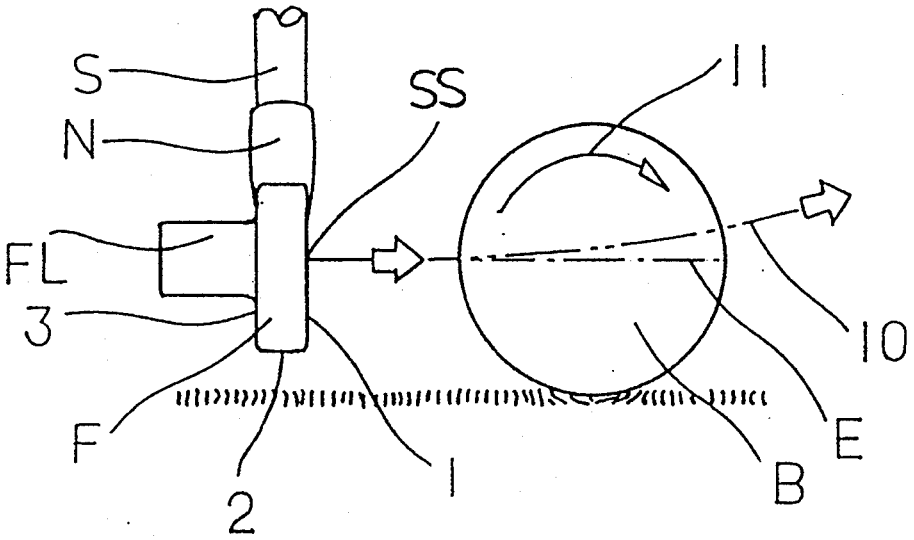
FIG. 9 PRIOR ART
FIG. 9 is a view illustrating directions of the face on and after the impact as well as rotation of the ball when the putter head has a flange member joined thereto at the back surface thereof at a midpoint between the upper and lower ends of the face member, the face being maintained perpendicular to the turf surface.
Figure 10:
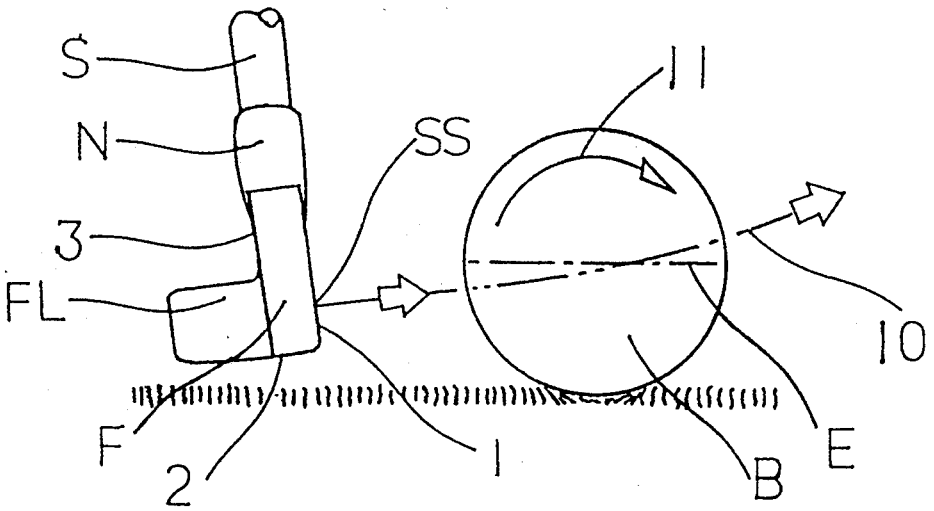
FIG. 10 PRIOR ART
FIG. 10 is a view illustrating directions of the face on and after the impact as well as rotation of the ball when the putter head has a flange member joined thereto at the back surface thereof at a lower portion thereof, the direction of the face being an upper blow.
Figure 11:
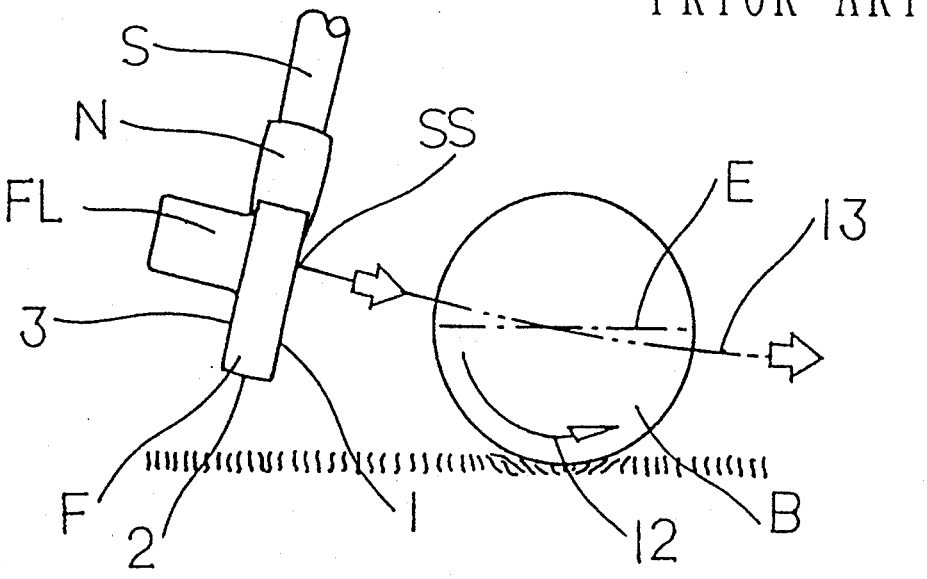
FIG. 11 PRIOR ART
FIG. 11 is a view illustrating directions of the face on and after the impact as well as rotation of the ball when the putter head has a flange member joined thereto at the back surface thereof at an upper portion thereof, the direction of the face being a down blow.
Figure 12:
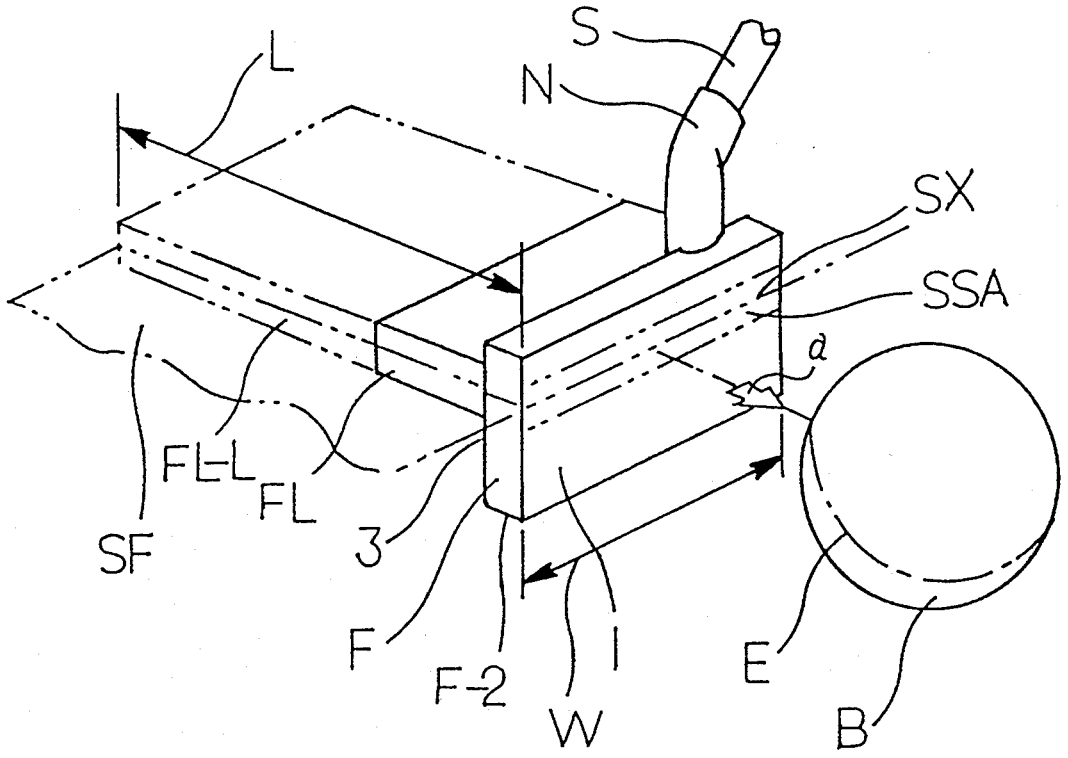
FIG. 12 PRIOR ART
FIG. 12 is a view used to explain a putter head with a flange member extending backward.
Figure 13:
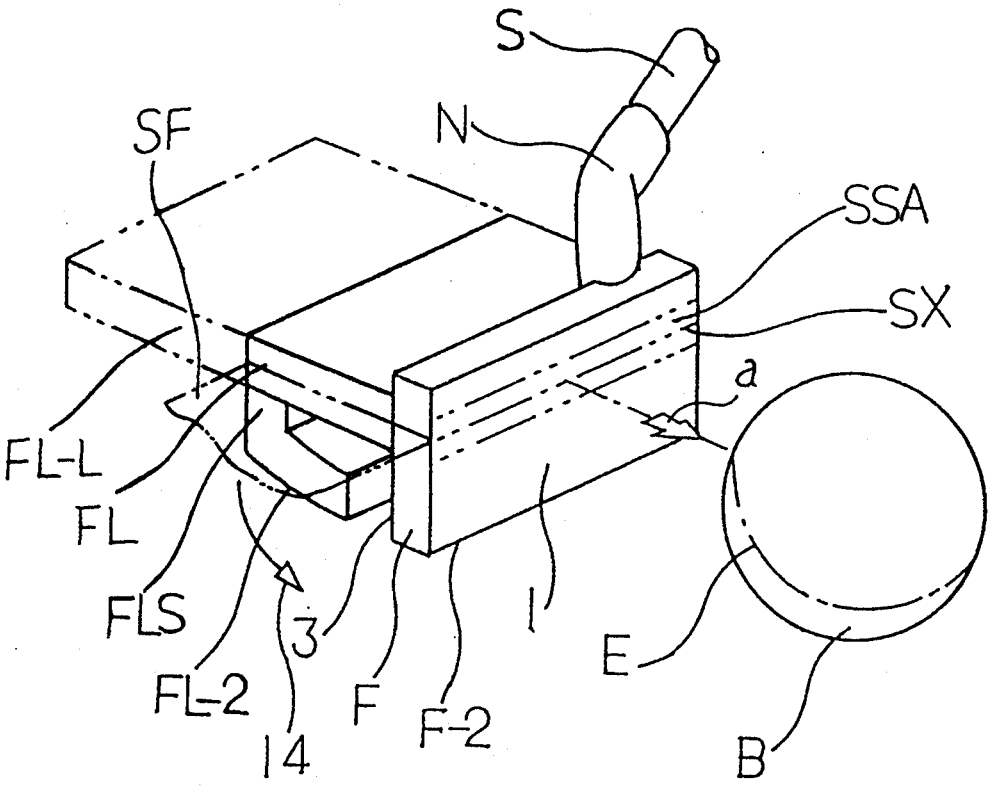
FIG. 13 is a perspective view showing an underlying principle of a putter head in accordance with the present invention.
Figure 14:
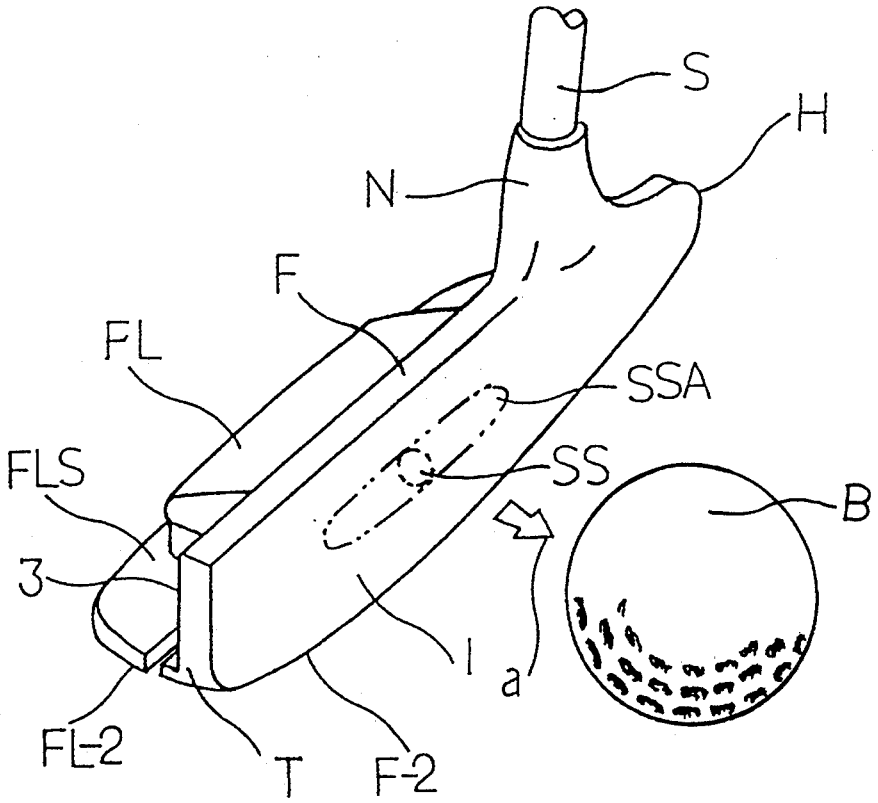
FIG. 14 is a schematic perspective view of a first embodiment of the present invention.

FIG. 13 is a schematic perspective view illustrating the underlying principle of a putter head in accordance with the present invention. FIG. 14 shows a first embodiment embodying the principle.

A face member F with a face 1 defines at its lower end a sole F-2 and has a back surface 3. A flange member FL is joined to the back surface 3 such that at least part of the joint surface is within a range of position of the sweet spot reference plane SF, i.e., (diameter of ball)$\times\frac{1}{2}$—((depth of ball sunken below turf surface)+(height of sole above turf surface)) measured vertically from the lowermost end of the head.

More specifically, the height of at least part of the joint surface is within a range of 15 mm$\pm$3 mm measured vertically from the lowermost end of the head.

The flange member FL extends substantially backward or opposite to the putting direction a such that at least part in cross section of the flange member FL perpendicular to the putting direction a is aligned with or below the joint surface.

Figure 15:
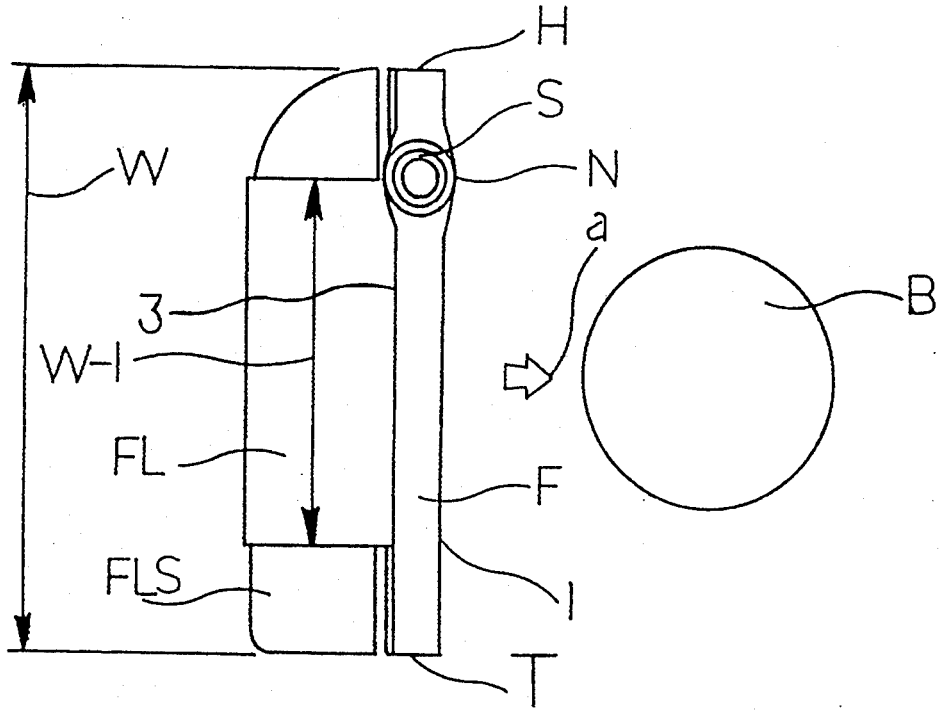
FIG. 15 is a top view thereof.

A sole member FLS depends from the extending flange member FL which in turn has distance or width W-1 in the directions to toe T and heel H. It is to be noted that two or more flange members FL with total distance W-1 in the directions to toe T and heel H may be employed and that the number of the flange members does not affect the function thereof at all. The head shown in FIGS. 14 and 15 has the single flange member FL.

The width W-1 of the flange member or members FL is not excess of the distance W between toe T and heel H of the face member F. The number and width W-1 of the flange members are to be determined depending upon material and total weight of the putter head used.

As shown in FIGS. 13 to 16, the depending sole member FLS defines a sole FL-2 which is different from the sole F-2 of the face member F.

The sole FL-2 is not joined to but spaced apart from the sole F-2 and back surface 3 of the face member F so that the total weight of the flange member FL and the sole member FLS is supported by the joint surface between the flange member FL and the back surface 3 of the face member F. As a result, the weight of the face member F is concentrated to the joint surface and therefore the sweet spot area SSA exits within the joint surface. More particularly, the putter head in accordance with the present invention produces the same effect as that of the hammer type putter head described above. A golfer feels that he or she strikes the ball B by the leading end and joint surface of the flange member FL rather than by the face 1 of the face member F so that the sweet spot area SSA can readily and accurately contact the ball B.

Figure 16:
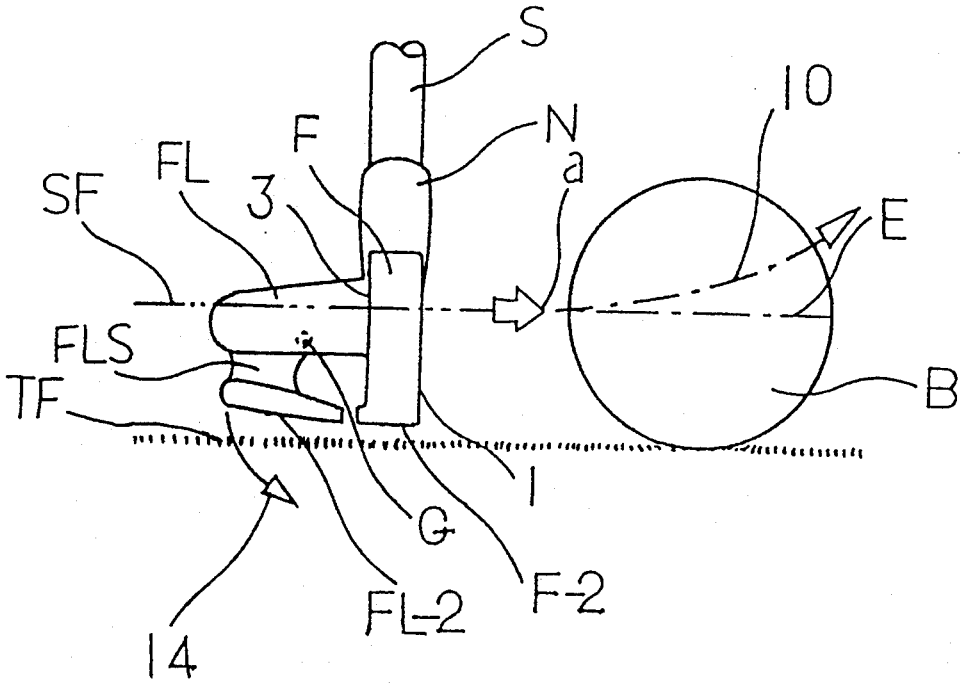
FIG. 16 is a front view thereof.

Furthermore, as shown in FIG. 16, the center of gravity G is located apart from the face 1 at a lower position so that force is applied to the terminal end of the extending flange member FL to rotate the same about the neck N in the direction indicated by an arrow 14. As a result, it becomes easier for a golfer to make backswing such that the direction of the face 1 becomes substantially equal to that adjusted upon address. That is, the adjustment made upon address can be easily reproduced at the time of putting impact and the face 1 can be moved in the upper blow direction 10 after the impact.

Figure 17:
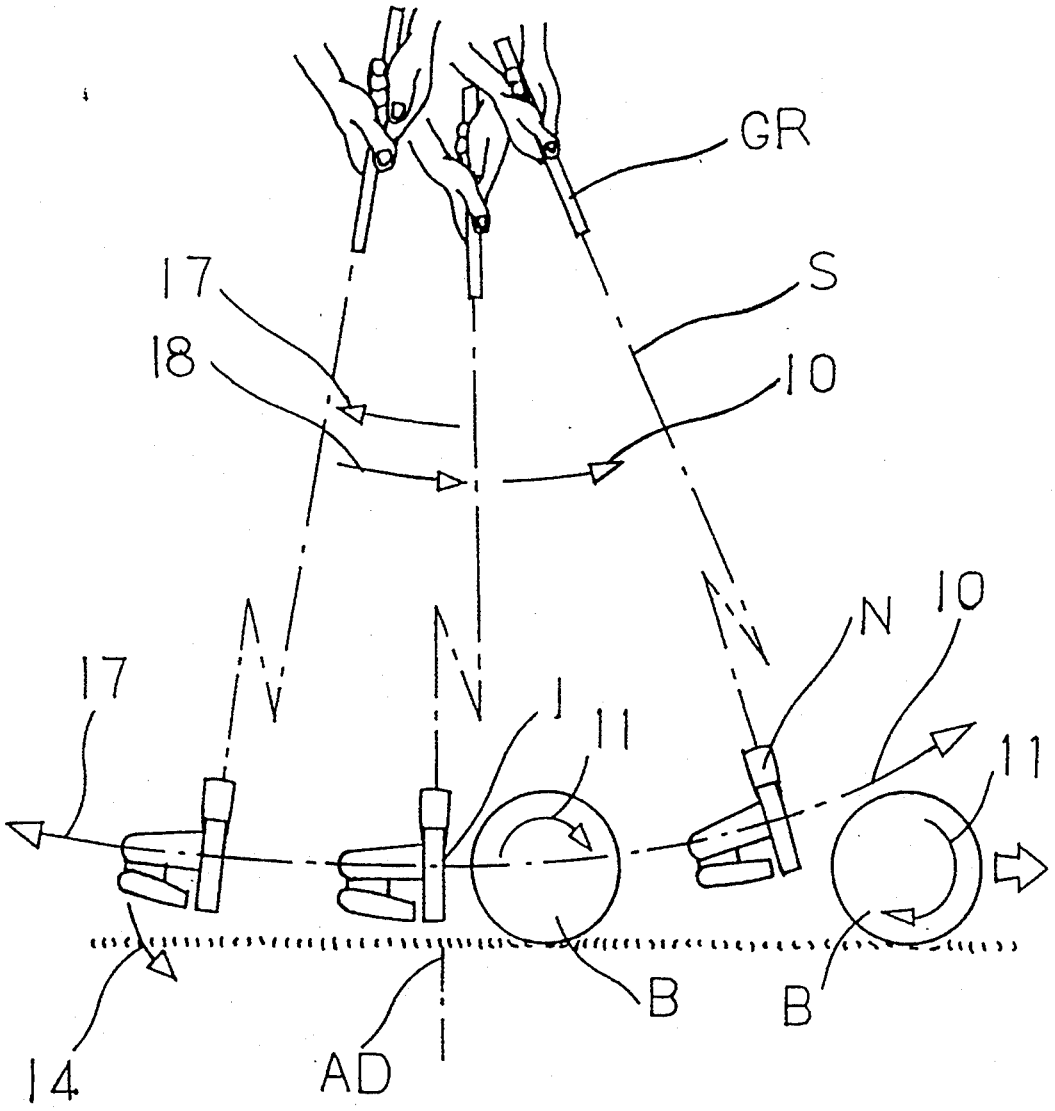
FIG. 17 is a schematic front view illustrating the putter before, upon and after the impact.
Figure 18:
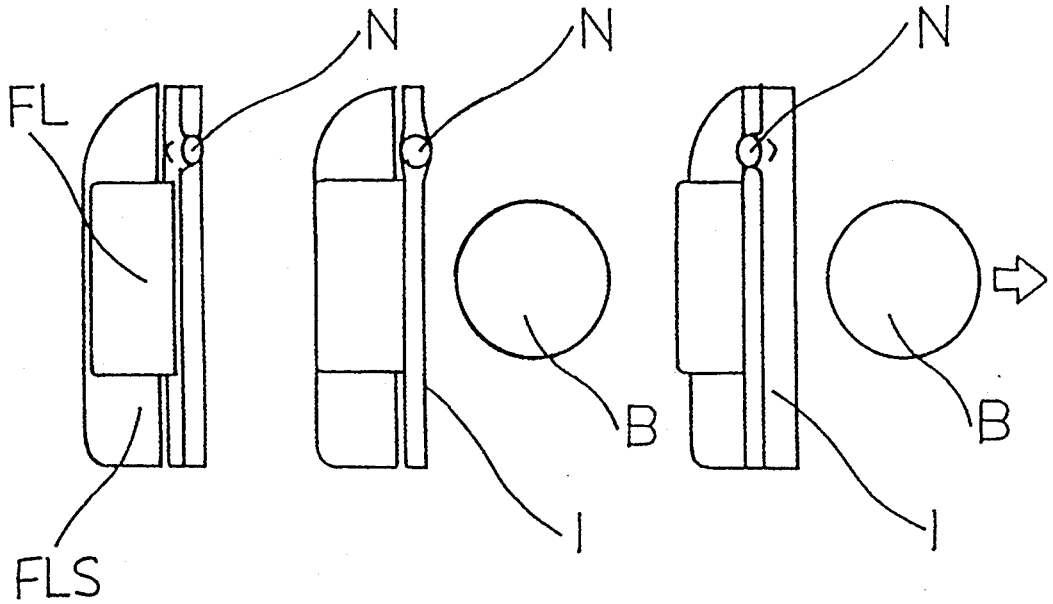
FIG. 18 is a top view thereof.

FIG. 17 is a front view schematically illustrating the movement of the putter head in accordance with the present invention and FIG. 18 is a top view thereof.

When a putter shot is made with the putter head in accordance with the present invention, the address position is a lowermost swing point AD or the point which is the center of the front side of the golfer's body. Address must be made such that the face 1 is perpendicular to the turf surface TF at the position AD. After the backswing indicated by arrows 17 and the downswing indicated by an arrow 18, the putting impact must be controlled. When the adjustment of the putter upon address can be accurately reproduced, the sweet spot area SSA on the face 1 accurately strikes the ball B since the joint position of the flange member is selected to be on the upper side. After the impact, the face 1 naturally follows in the upper blow direction indicated by an arrow 10 and the putter head imparts the top spin in the direction indicated by an arrow 11 to the ball B immediately after the impact, whereby the ball B can roll with the minimum resistance encountered from the turf.

Figure 19:
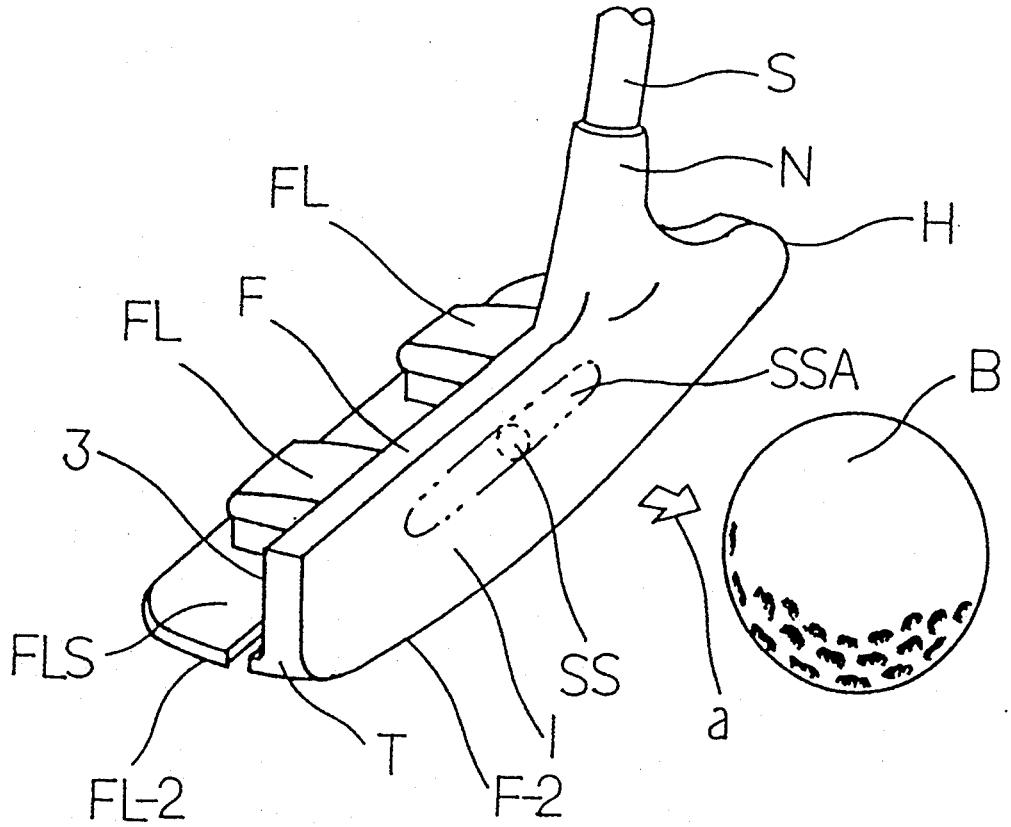
FIG. 19 is a perspective view illustrating a variation of the first embodiment.
Figure 20:
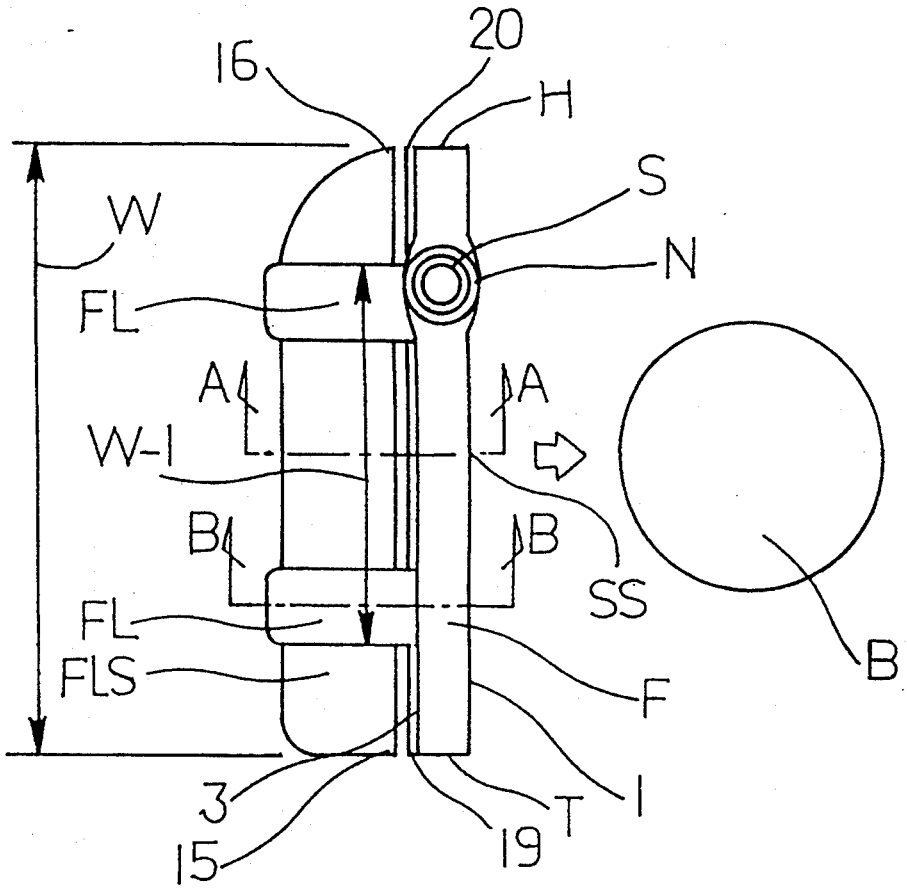
FIG. 20 is a top view thereof.
Figure 21:
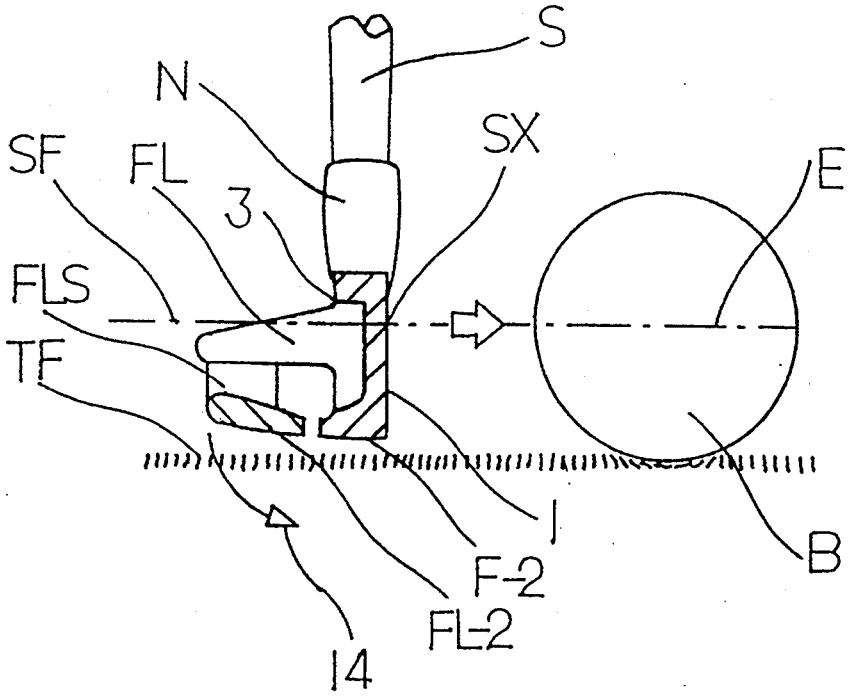
FIG. 21 is a sectional view thereof taken along the line A—A shown in FIG. 20.
Figure 22:
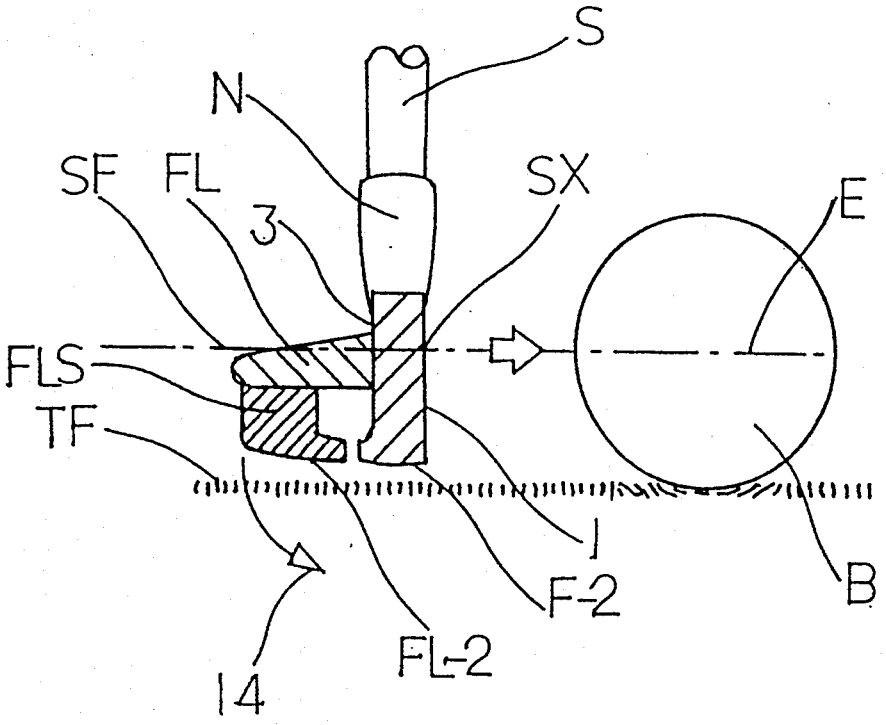
FIG. 22 is a sectional view thereof taken along the line B—B shown in FIG. 20.

FIG. 19 is a schematic perspective view illustrating a putter head according to a variation of the first embodiment which has two flange members; FIG. 20 is a top view thereof; FIG. 21 is a sectional view taken along the line A—A of FIG. 20; and FIG. 22 is a sectional view taken along the line B—B of FIG. 20.

Features of the putter head illustrated in FIGS. 19 to 22 reside in that a plurality of (two in this embodiment) separate flange members FL are joined to the rear surface 3 of the face member F such that the flange members FL are spaced apart by a same distance from the center of the sweet spot SS of the face 1 to the toe T and heel H, respectively, and that a common sole member FLS is depending from the flange members FL.

As best shown in FIG. 21 illustrating the sweet spot SS in cross section, the portion of the rear surface 3 between the flange members FL is recessed to uniformize the sweet spot effect over the sweet spot area SSA. In other words, the rear surface 3 of the face member F at the sweet spot position to which strong repulsive power will act is made thinner to minimize any difference in repulsive power over the effective area of the sweet spot SS between the flange members FL, so that the sweet spot effect is uniformized over the sweet spot area SSA.

Distance W between the toe T and heel H of the putter head may be suitably selected and is not limited by official golf rules. As a result, the distance W varies from one putter to another depending upon choices of golfers.

When a putter head in accordance with the present invention is so designed that the distance W is relatively longer, some devise or countermeasure is required to make the putter head light in weight otherwise putting shot may be adversely affected by the weight of the putter head.

Among the face member F, the flange member or members FL and the sole member FLS which together constitute a substantial weight of the putter head, reduction in weight of the face member F is limitative not only by official golf rules but also from the actual structural viewpoint since the inherent object of the face member F is to strike a ball. That of the flange member FL is also difficult from the structural viewpoint since the flange member or members FL must support the sole member FLS depending therefrom. After all, in order to reduce the overall weight of the putter head, it is effective to reduce the weight of the sole member FLS and decrease the thickness of the sole FL-2.

When this idea is applied to the putter head shown in FIG. 20 and the sole member FLS is reduced in thickness, portions 15 and 16 of the sole member FLS tend to easily deform which extend toward the toe T and heel H of the face 1 beyond or outside of the distance W-1 of the flange members FL joined to the back surface 3 of the face member F and spaced apart from the center of the sweet spot position of the face 1 by the same distance and which are in the form of plate and their leading ends are free; and the strength of the sole member FLS may be reduced against official golf rules. In order to overcome the problem and reinforce the leading end portions 15 and 16 of the sole member FLS without leaving the true spirit and adversely affecting the features of the present invention, the leading end portions 15 and 16 are to be joined to opposing surfaces 19 and 20 or portions of the sole F-2 or of the rear surface 3 of the face member F. This is embodied by a second embodiment of the present invention shown in FIGS. 23 and 24.

Figure 23:
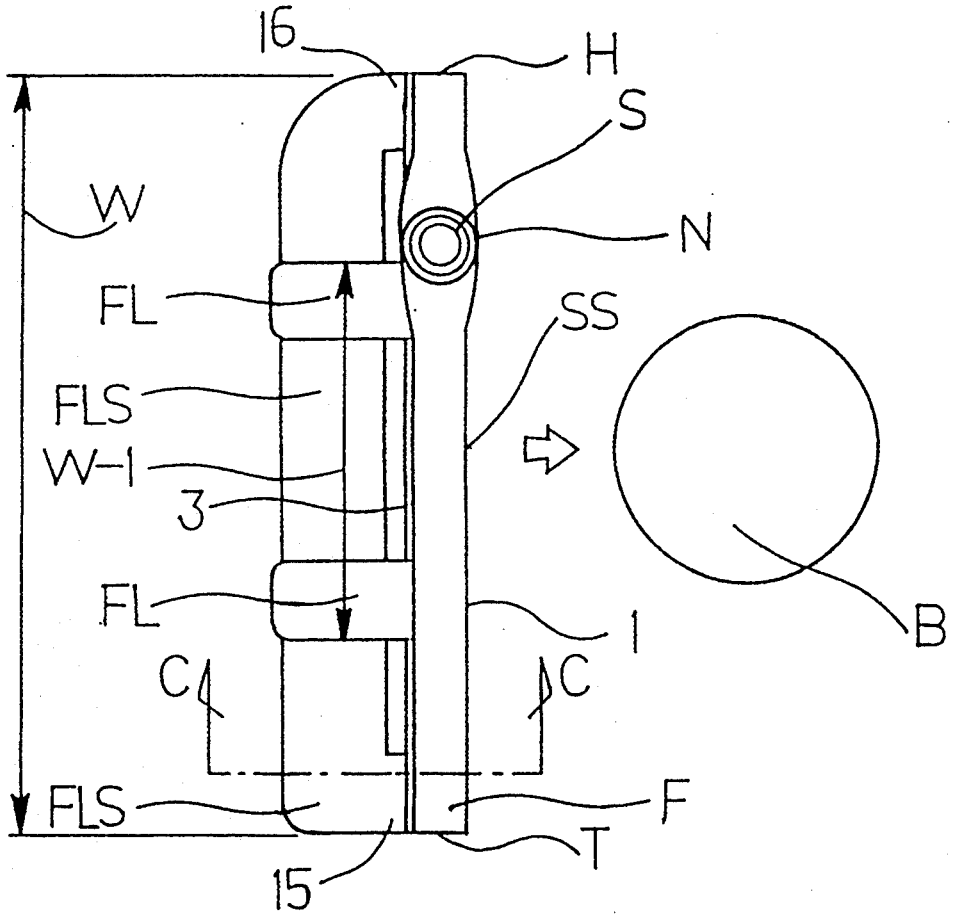
FIG. 23 is a top view of a putter head in accordance with a second embodiment of the present invention.
Figure 24:
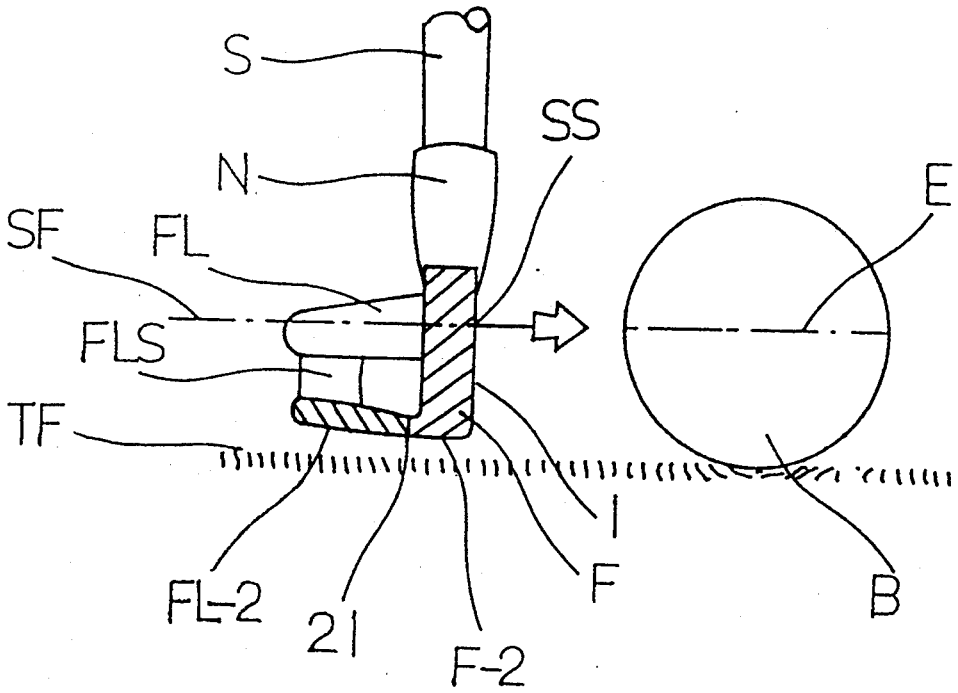
FIG. 24 is a sectional view thereof taken along the line C—C shown in FIG. 23.

FIG. 23 is a schematic top view of a putter head according to the second embodiment with the distance W between the toe T and heel H being relatively longer; and FIG. 24, a sectional view of the leading end portion 15 of the sole member FLS taken along the line C—C of FIG. 23.

More specifically, two flange members FL are joined to the rear surface 3 of the face member F such that they are spaced apart by the same distance from the center of the sweet spot SS. The leading end portions 15 and 16 of the sole member FLS extending beyond or outside of the distance W-1 of the flange members FL are joined directly or through rigid members to the opposing sole F-2 defined by the face member F. Provided that points 21 of joint are beyond or outside of the width W-1 of the flange members FL and toward the toe T and heel H, respectively, adverse effects thereby are negligible and the second embodiment enjoys the same features as those of the first embodiment described above with reference to FIGS. 13 to 16.

So far the term "joint" has been used, but it is to be understood that it includes joint with suitable adhesives or by welding as well as integration by casting or the like. Official golf rules stipulate that a club must be in unitary construction.

Furthermore, the term "rigid member" is used in this specification so as to refer to a member made of material for the satisfactory transmission of energy other than elastic material such as rubber, sheet-like material which springs back, material which is easily subjected to deformation.

It is to be understood that the present invention is not limited to the above-mentioned embodiments and that various modifications may be made without leaving the true spirit of the present invention.

A head of a golf club in accordance with the present invention will attain the following features.

Even when a golfer makes a putting shot in a conventional manner, the face of the putter head can accurately contact at its effective region of sweet spot with a horizontal equator of a ball upon impact; and after the impact, the face naturally follows the path in an upper blow direction. It is therefore not necessary at all to intentionally change the direction of the face in the upper blow direction immediately before the impact.

Immediately after the impact, the top spin is imparted to the ball so that the latter rotates forward, encountering a minimum degree of resistance from the turf of the putting green.

It becomes possible for a golfer to accomplish an accurate putting shot in accordance with a manual and exclude dependency upon conventional putting-shot know-how acquired by personal feeling.

It has been said that an accurate putting shot can be acquired only by those having special golf talent; but in accordance with the present invention, if a golfer repeats putting-shot practices according to a manual, he or she can attain putting-shot skill in proportion to an amount of his/her practice and a degree of his/her efforts.

What is claimed is:

1. A head of a golf club comprising a face member with a substantially flat face for driving a ball, a sole defined by a lower portion of said face member, at least one flange member joined to a rear surface of the face member, at least a part of a joint surface between said flange member and said rear surface of said face member being within a range of (diameter of ball)$\times\frac{1}{2}$—((-depth of ball sunken below turf surface)+(height of sole of face member above turf surface)) measured vertic from a lowermost end of the head, said flange member extending substantially in a direction opposite to a direction of said ball to be struck such that at least a part of a vertical section of said flange member with respect to the direction of said ball to be struck is at most the same height with said surface of the joint, and a sole member depending from said flange member to define a further sole.

2. A head as defined in claim 1 wherein said at least a part of the joint surface between said flange member and said rear surface of said face member is at a height of 15 mm$\pm$3 mm measured vertically from said lowermost end of said head.

3. A head as defined in claim 1 wherein said further sole is joined at its end portions outside of the distance of the flange member to the back surface of the face member for reinforcement.

4. A head as defined in claim 2 wherein said further sole is joined at its end portions outside of the distance of the flange member to the back surface of the face member for reinforcement.

* * * * *